US006817375B2

(12) United States Patent
Sorochinsky et al.

(10) Patent No.: US 6,817,375 B2
(45) Date of Patent: Nov. 16, 2004

(54) TORSION GENERATOR

(76) Inventors: Alexander Sorochinsky, Kelezkaja str., 84-50, Viniza (UA); Hristo Stojanov, J.K. Drujba Bl.76, Vh.A, 1592 Sofia (BG); Hristo Ivanov, bul Praga 22, 1000 Sofia (BG); Marija Stojanova, J.K. Drujba Bl.76, Vh.A, 1592 Sofia (BG)

( * ) Notice: Subject to any disclaimer, the term of this patent is extended or adjusted under 35 U.S.C. 154(b) by 130 days.

(21) Appl. No.: 10/009,618

(22) PCT Filed: Apr. 10, 2001

(86) PCT No.: PCT/GB01/00010

§ 371 (c)(1),
(2), (4) Date: Dec. 11, 2001

(87) PCT Pub. No.: WO01/79765

PCT Pub. Date: Oct. 25, 2001

(65) Prior Publication Data

US 2002/0159884 A1 Oct. 31, 2002

(30) Foreign Application Priority Data

Apr. 12, 2000 (BG) ..... 104334

(51) Int. Cl.[7] ..... F15C 1/16

(52) U.S. Cl. ..... 137/14; 137/809; 137/810; 137/811; 137/812; 137/813; 137/560; 251/368

(58) Field of Search ..... 137/808, 809, 137/810, 811, 812, 813, 340, 560, 14; 251/368

(56) References Cited

U.S. PATENT DOCUMENTS

| | | | | |
|---|---|---|---|---|
| 3,215,165 A | * | 11/1965 | Broadway | 138/46 |
| 3,373,759 A | * | 3/1968 | Adams | 137/809 |
| 3,631,873 A | * | 1/1972 | Swithenbank et al. | 137/808 |
| 5,971,023 A | * | 10/1999 | Clague et al. | 137/813 |

FOREIGN PATENT DOCUMENTS

| | | |
|---|---|---|
| DE | 19715754 C | 7/1998 |
| FR | 2709536 A | 3/1995 |
| LU | 55463 A | 4/1968 |
| RU | 2045715 C | 10/1995 |

OTHER PUBLICATIONS

Database WPI, Section PQ, Week 199624, Derwent Publications Ltd., London, GB, Class Q75, AN 1996–238011, XP002173377, 2000.

* cited by examiner

*Primary Examiner*—A. Michael Chambers
(74) *Attorney, Agent, or Firm*—Michael A. Mann; Nexsen Pruet Adams Kleemeier, LLC

(57) ABSTRACT

The torsion generator includes casing (1), in which at least one canal (2) is formed, whose inlet is located near to the casing (1) periphery. The longitudinal axis of the canal (2) passes on the logarithmical curve, wherein the mathematical sequence of the construction of the coordinates is different for each section of the curve. The outlet of the canal (2) communicates with the camera (3), formed inside the casing (1) and is connected with an outgoing pipeline (4). The inlet of the canal (2) is located tangentially, and the outlet—axially to the casing (1).

23 Claims, 3 Drawing Sheets

TORSION GENERATOR

TECHNICAL FIELD

The present invention refers to the method of torsion influence on working media and torsion generator with application in different spheres of power engineering, chemistry, microbiology, everyday life and medicine.

PRIOR ART

Different types of generators are known in the power engineering, which use different energy sources (in hard, liquid and gaseous state), at the burning of which a number of substances are liberated, which are noxious to man, nature and the biosphere.

Nowadays methods and installations for obtaining energy from hydrogen, solar energy and, manageable thermal and nuclear processes are known, which however have only limited application, because they are not sufficiently effective yet and/or are dangerous.

From a Ukrainian patent a thermal generator is known, which consists of casing, in which a canal in the form of Archimed spiral is formed. The inlet of the canal lies on the side surface of the casing and its outlet communicates with a cavity, formed inside the casing.

The method of generating heat, realized with this well-known generator, is based on the principal of rising the kinetic energy of the working fluid, passing through the canal, due to the friction, on the one hand, between the working fluid and the walls of the canal, and on the other hand—of the intermolecular friction.

A disadvantage of this method and the thermal generator is their relatively low efficiency.

There are no methods of torsion influence upon working fluid known, neither are torsion generators, which are based on the latest achievements of the theory of the physical vacuum and the torsion fields.

SUMMARY OF THE INVENTION

The aim of the present invention is to create method of torsion influence on working media and torsion generator realizing the method which have higher technical and economical efficiency and offer harmless and effective obtaining of ecologically clean energy in sufficient quantities.

An additional aim of the invention is to offer applications of the torsion generator for obtaining thermal energy, biological purifying of water, purifying, softening and deaeration of industrial water, drinking water and water for everyday needs, for stimulation of the vegetable and saplings growth, for desalting of sea water, for speeding of the aging process of alcoholic drinks and for influence; upon the vitality of microorganisms, which applications are highly effective and at the influence does not liberate and do not leave noxious substances, which are pernicious for life and nature.

The aim of the intention is achieved by a method for torsion influence upon working, media wherein a working fluid is passed through three capacities. In the first capacity the working fluid increases its speed at a substantial drop in the pressure. In the second capacity a wave torsion field is created through definition of the trace for passing of the working fluid with logarithmical curve, in which the mathematical sequence of constructing its coordinates is different for each section of the curve, by rotation of the working fluid with angle moment, proportional to the mass of the work fluid and to its angle velocity. In the third capacity the hydro-dynamic processes of the turbulent movement of the working fluid stabilize.

In one of the method's variants the working fluid is passed in the first capacity at a pressure not lower that 0, 1 MPa.

The preferred working fluid pressure is higher than 0, 6 MP.

In other expedient execution of the method the working fluid gets out of the first capacity with pressure lowered from 10 to 40%.

In other variant of execution of the method the work fluid is water.

The aim is also achieved with the creation of torsion generator according to the present invention, which includes a casing, in which at least one canal is formed, whose inlet is located near to the casing periphery. The longitudinal axis of the canal passes in logarithmic curve, in which the mathematical sequence of construction of its coordinates is different for each section of the curve. The canal outlet communicates with a camera, formed in the inside of the casing and connected with outgoing pipeline, whose canal inlet is tangentially located, and the canal outlet is axially located to the casing.

It is expedient that the generator casing is formed of solid material, preferably metal, but it may also be ceramics, metal ceramics or plastic.

In one preferable variant of execution of the torsion generator, the outer part of the casing is made by one metal, and the inside part of the casing is made from other metal.

At this variant it is expedient that the outer part is made of steel, and the inside—of titanium.

It is preferable, that the camera inside the casing has essentially symmetric cross-section, and most preferable is that its form is cylindrical.

In other variant of execution of the torsion generator, the longitudinal axis of the camera is located eccentrically to the casing axis.

In other preferable variant of execution of the torsion generator, two or more canals are formed in the casing, which are located just adjacently. It is preferable that in the canal walls are formed outlets connecting the inside cavities of the canals.

The additional aim is achieved by using the above described torsion generator for influence upon work environments, in order to obtain:

- thermal energy;
- biological purifying of water;
- purifying, softening and deaeration of industrial, drinking water and water for everyday necessities;
- stimulation of the vegetable and saplings growth;
- desalting of sea water;
- speeding of the aging process of alcoholic drinks;
- influence upon the vitality of microorganisms.

The advantages of the invention are concluded in the fact, that it gives the possibility to obtain thermal energy with very big energy efficiency and without liberation of noxious substances and respectively, without pollution of the environment. At the usage of the torsion generator according to the present invention for changing the physical, chemical and biological properties of the work environment, a high degree of purifying is obtained (up to about 100%), without liberating noxious substances and without polluting the environment. The same purifying effect (up to around 100%) is achieved by purifying, softening and deaeration of water.

A substantial speeding of the growth is achieved by using the torsion generator according to the invention for stimulation of vegetable and sapling growth. The generator allows also sea water desalting in order to obtain water with characteristics, close to that of the sweat water. The torsion field, created in the generator, also influences different microorganisms, by greatly decreasing their vitality. With the torsion generator can also be achieved speeding of the aging process of alcoholic drinks, without the usage of other well-known processes and compositions, which can worsen the taste of the beverages produced.

EXAMPLES OF EXECUTION OF THE INVENTION

The torsion generator (FIG. 1) consists of a casing 1, in which the canal 2 is formed. The inlet of the canal 2 is near to the periphery of casing 1. The longitudinal axis of the canal 2 passes in logarithmic spiral, in which the mathematical sequence of constructing her coordinates is different for each section of the spiral.

The outlet of canal 2 exits in camera 3, formed in the inside of casing 1 and connected with outgoing pipeline 4.

Figure 1:
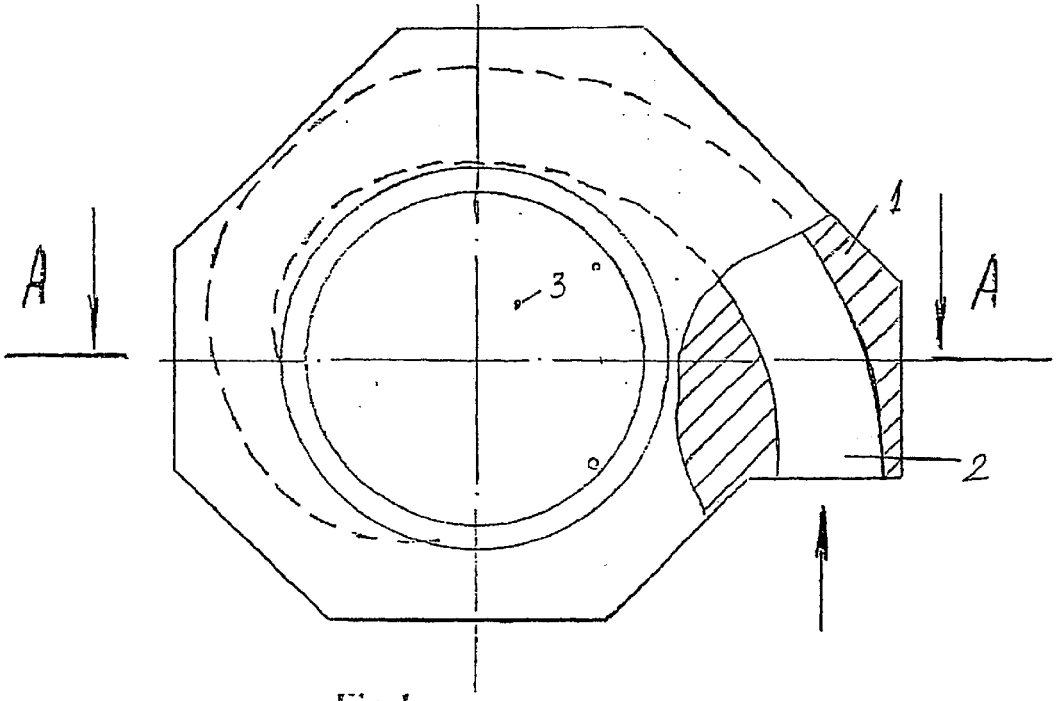
FIG. 1 shows a top view and a partial section of the torsion generator according to the invention.
Figure 2:
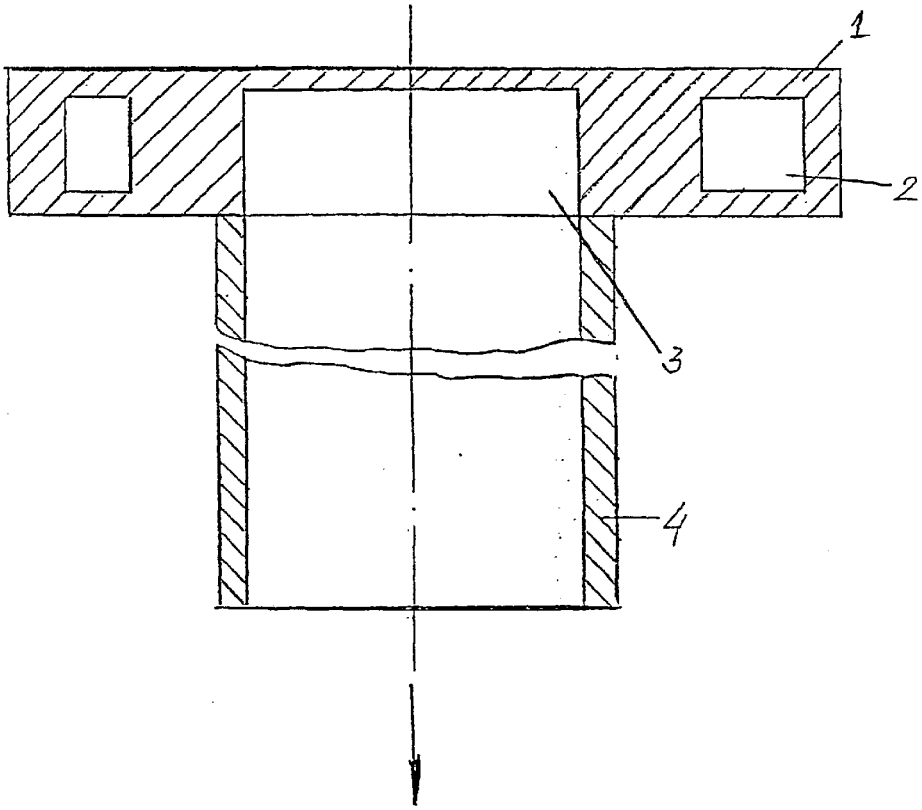
FIG. 2 is a cross-section on the A—A line of the torsion generator from FIG. 1.

On the execution, shown on FIG. 1, the casing 1 is made of solid material. The outer side wall of the casing 1 can follow the form of canal 2, and an economy of the material, from which the casing 1 is made, is realized. At this execution the longitudinal axis O1 of the camera 3 is located eccentric to the geometry axis O2 of casing 1. The camera 3 can have arbitrary form, but it is preferable that it has symmetrical cross-section. The most appropriate form of this camera is in the form of cylinder, and in this way it will be easy to attach the outgoing pipeline 4 to it.

Figure 3:
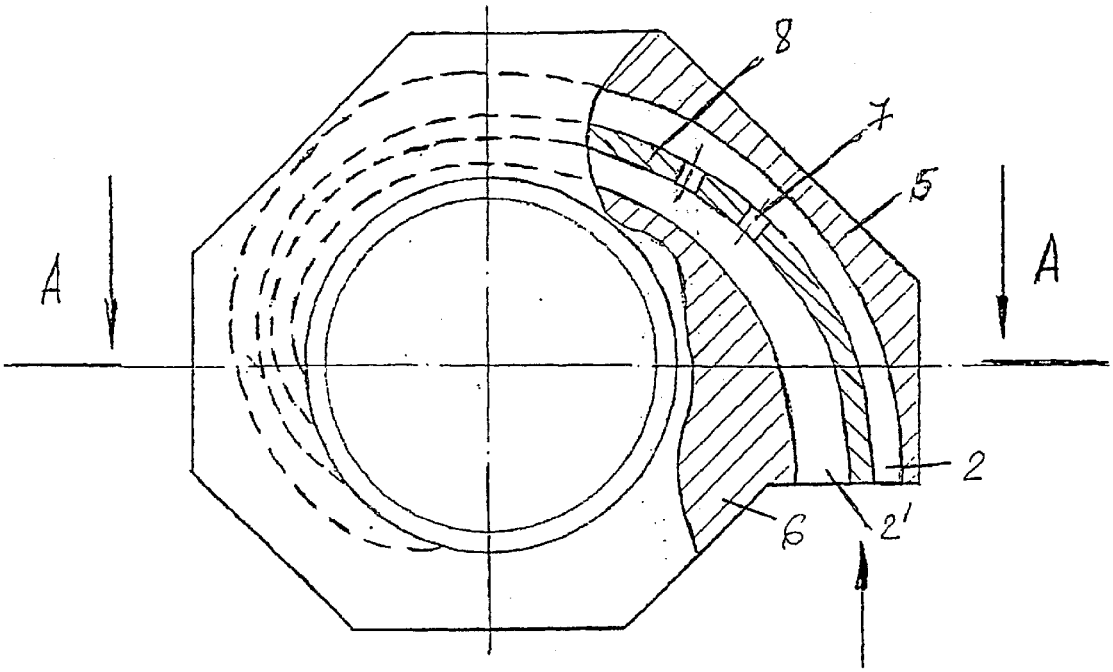
FIG. 3 is a top view and a partial section of the torsion generator with two canals according to one variant of execution of the invention.
Figure 4:
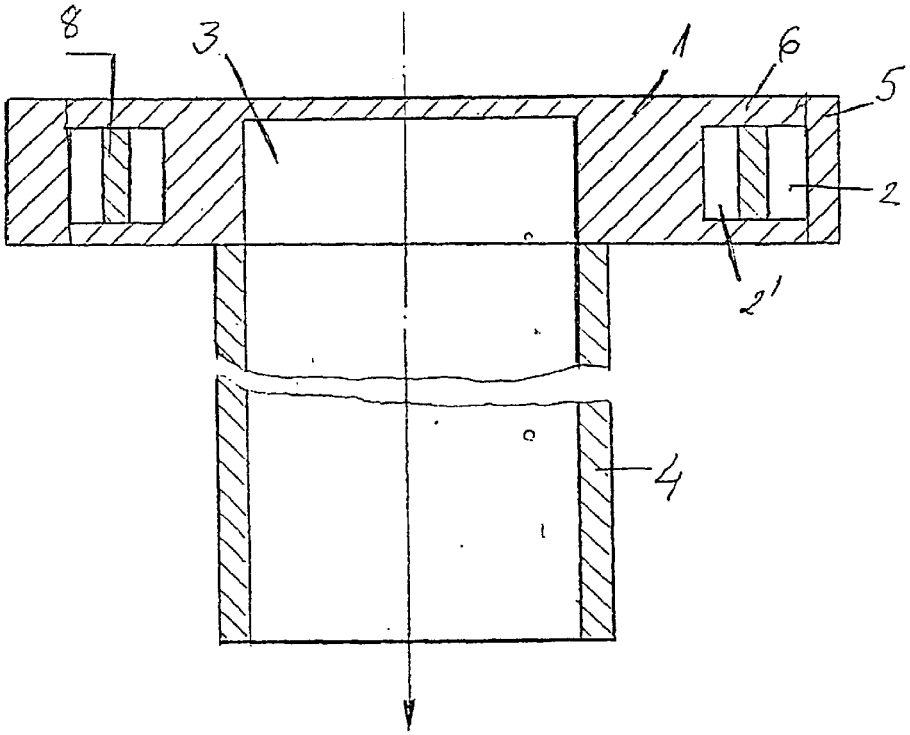
FIG. 4 is a cross-section on the B—B line of the torsion generator from FIG. 3.

In the execution, illustrated in FIGS. 3 and 4, the casing 1 has two parts—outer part 5 and inner part 6. These two parts can be made of two different metals, for example steel and titanium, and in this way the mechanic wear-resistance of the walls of the canal 2 is increased.

In the casing 1 two or more canals can be formed, and the torsion generator from FIGS. 3 and 4 is shown with two canals 2 and 2'. A connection is provided between the canals 2 and 2' by forming through holes 7 in the medial wall 8, dividing the two canals 2 and 2'.

The torsion generator, according to the present invention acts in the following way:

In the canal 2 (canals 2 and 2' respectively) is passed a working fluid (preferable water) with high velocity and pressure of about 0, 6 MPa. In the first section of the canal 2, which represents about ⅓ of the total canal length, the water increases its velocity at a considerable decrease of the pressure and enters the second section of the canal 2 with decreased pressure (the decrease amounting to about 30% of the pressure in the first section). The second section of the canal 2 also represents about ⅓ of the total canal length. Due to the special geometry of the canal 2 and to the fact, that the water enters the second section and passes through it with a large angle moment, proportional to the water mass and to its angle velocity, in this section wave torsion field is created, which influences the structure of the water.

The working fluid (fluid) under pressure, provided for example by water pressure pump, is passed in the tangential canal 2 of the torsion generator. The canal 2 has the form of logarithmic spiral and ensures that the flow passes in such a way, that its velocity is increased due to the decrease of the rotation radius to the center of the canal spiral. The working fluid pressure decreases in accordance to the Bernoulli's law. The coordinates for constructing the spiral are planned mathematically in such a way, that wave torsion field is created. Due to the friction of the working fluid in the canal walls, it warms. Simultaneously, due to the rotation of the working fluid in the region of the spiral, a torsion field is created, which influences informational the nuclear structure (spinning and wave) of the working fluid. The energy tension created causes torsion, and the cord ties and the angles for connecting the atoms of the working fluid change. After the working fluid goes out of the generator exit, the processes stabilize and recover, at the expense of the energy of the physical vacuum.

At such influence, the oscillating movement of the atoms and molecules of the working fluid considerably increases, which leads to rise of the temperature of the fluid at little energy consumption at the entrance.

For greater power it is expedient to use two or more canals 2, 2', connected through the holes 7. At such execution the pressure of the working fluid in the two canals is equalized, and the system is balanced hydraulically.

At the fluid entering of the third section, which represents also ⅓ of the canal 2 length, the hydrodynamic processes of the turbulent movement of the fluid stabilize, and the pressure falls.

The above described torsion generator can be applied in many technical fields.

Figure 5:
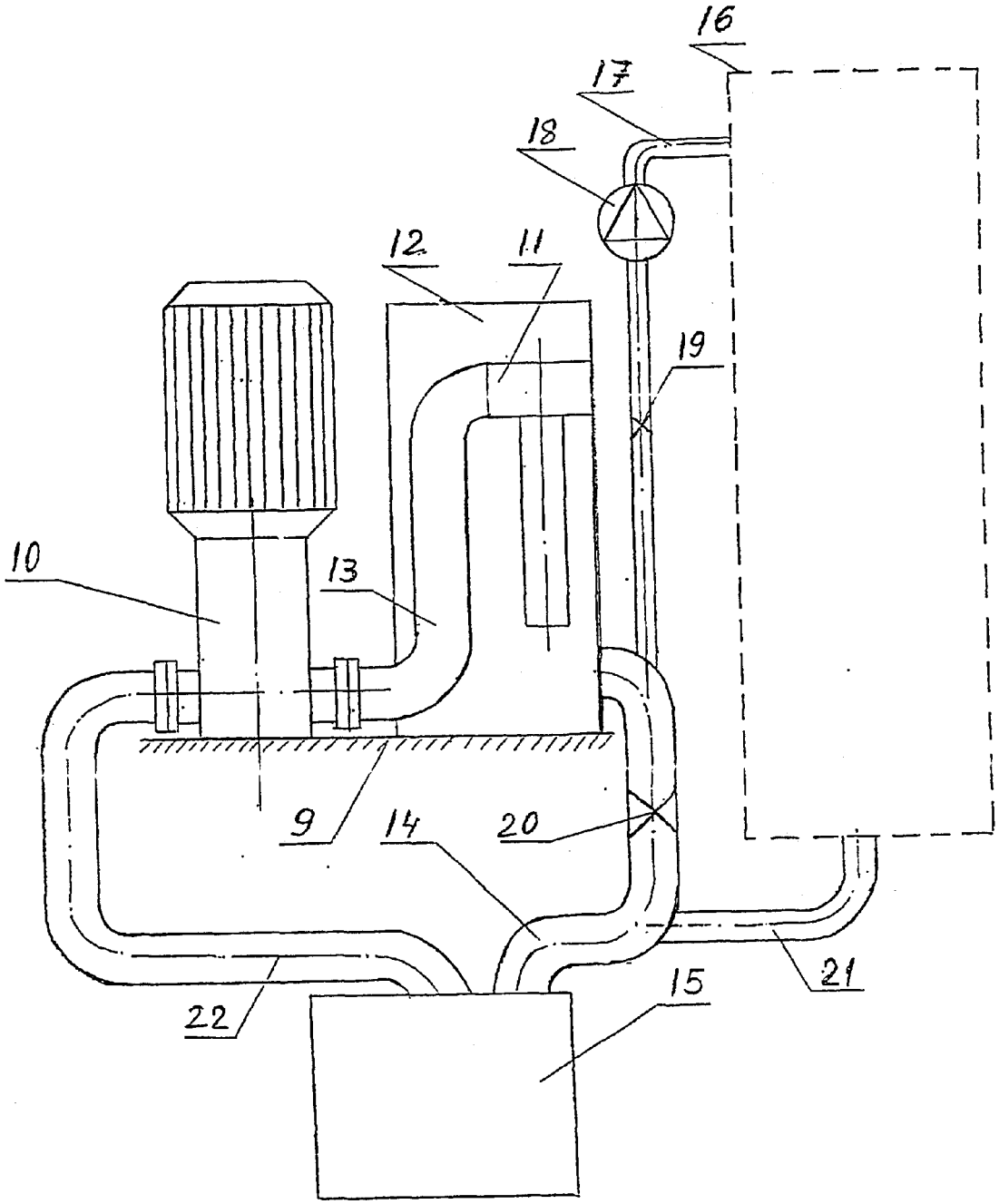
FIG. 5 illustrates a block diagram of a heating installation, including torsion generator, according to the present invention.

When this generator is used for obtaining thermal energy, it can be included as a part in various heating installations. An example of one such installation, which should in no case be viewed as constraining and is only illustrative, is showed on FIG. 5.

The installation includes steel base 9, upon which a water pressure pump 10 and the torsion generator 11 are located. The torsion generator 11 is placed in the volume vessel 12. This vessel can be made of metal, but there is no obstacle that it be made of every other suitable for the purpose material. The pressure side of the pump 10 is connected through pipeline 13 with the entrance of the canal 2 of the torsion generator 11. The volume vessel 12 has two outlets, one of which is connected through pipeline 14 with the compensatory vessel 15. The other outlet of the volume vessel 12 is connected with the heating system 16 through pipeline 17. A circulation pump 18 can be included in the pipeline 17 when the heating system is designed for larger heating areas. In the same pipeline is placed the valve 19. In the pipeline 14 is included the valve 20. The outlet of the heating system 16 is connected through pipeline 21 to the compensatory vessel 15, whose outlet is connected through the pipeline 22 with the side of the water pressure pump 10.

The action of the installation is the following:

At first the volume vessel 12 is filled with water. The valve 20 opens and the valve 19 closes, after that the water pressure pump 10 is switched on. The pump takes the water from the compensatory vessel 15 and injects it into the canal 2 of the torsion generator 11. In result of the above described processes, which realize at the passing of the water through the canal 2, this water starts to heat up. The water circulates in this circle until it heats to the desired temperature. After that the valve 19 opens, and the heated water is passed through the circulation pump 18 in the pipeline 17 towards the heating system 16. The heated water can be passed also without the circulation pump, when small areas are heated and the vacuum, created by the suction side of the water pressure pump, is sufficient for the circulation of the water in the heating outline.

The heating system can be designated for heating of residential, administrative and business buildings. In similar way the torsion generator can be switched into the heating systems of different types of dryers (for tobacco, fruit, vegetables, wood and others).

The outgoing pipeline can also be connected to heat exchanger, in order to obtain warm water for everyday life and industrial targets, as well as for obtaining wet steam with temperature up to 115 C.

An installation of this kind can be used in pasteurization and sterilization processes in the food industry.

Other possible application of the torsion generator is for heating and cleaning (mechanical and biochemical) of water in pools, installation vessels for greases, electrolytes and others. At this application previous circulation of the water for its heating to higher temperatures is not executed.

The mechanical and biochemical cleaning of different working fluids, including different waters, is made by passing these fluids through canal 2 of the torsion generator. By doing so an influence is exercised upon the fluids (together with all mechanic, chemical and biological admixtures, contained in the fluid). The influence is due to the torsion field created, which totally destroys the admixtures and changes the physical and chemical properties of the fluid.

The biological purification, the softening of water and the speeding of the aging processes in alcoholic beverages can be obtained also when the torsion generator works near to (for example 5–6 meters) the corresponding work environment. The remote influence is due to the fact that the torsion field influences at a certain distance from the torsion generator. This effect of the torsion field allows the usage of the torsion generator also for influence upon the vitality of different microorganisms—bacteria, germs and others.

What is claimed is:

1. A method for torsion heating of a working fluid, said method comprising the steps of:

passing a working fluid through a first portion of a canal, said canal defined by a casing, said first portion formed to increase the speed and reduce the pressure of said working fluid;

passing said working fluid through a second portion of said canal, said canal having a longitudinal axis that traces a logrithmical curve and being adapted to rotate said working fluid as said working fluid passes through said second portion; and passing said working fluid through a third portion of said canal, said third portion formed to stabilize the hydraulic processes of said working fluid.

2. The method according to claim 1 wherein said working fluid is passed from said first portion to said second portion with a pressure at least 0.1 MPa.

3. The method according to claim 2, wherein said working fluid is passed from said first portion to said second portion with a pressure at least 0.6 MPa.

4. The method according to claim 1, wherein said working fluid is passed from said first portion to said second portion with a pressure reduced by 10 to 40%.

5. The method according to claim 1, wherein said working fluid is water.

6. Usage of the torsion generator according to claim 1 for obtaining thermal energy.

7. Usage of the torsion generator according to claim 1 for biological purifying of everyday life and drinking waters.

8. Usage of the torsion generator according to claim 1 for purifying, softening and deaeration of water.

9. Usage of worked off water from the torsion generator according to claim 1 for stimulating the growth of plants and saplings.

10. Usage of the torsion generator according to claim 1 for speeding of the aging process of alcoholic beverages.

11. Usage of the torsion generator according to claim 1 for desalting of sea water.

12. Usage of the torsion generator according to claim 1 for influence upon microorganisms.

13. A torsion generator comprising a casing in which at least one canal is formed, said casing having a periphery and said canal having an inlet located near to said periphery and an opposing outlet, said canal having a longitudinal axis tracing a logarithmical curve in said casing, said casing further having a camera formed therein, in communication with said outlet of said canal, and wherein said inlet of the canal is oriented tangentially, and the outlet is oriented axially with respect to said casing.

14. The torsion generator according to claim 13, wherein said casing is made from solid material.

15. The torsion generator according to claim 14, wherein said solid material is metal.

16. The torsion generator according to claim 13, wherein said casing has an outer part and an inner part, and wherein said outer part is made of a first metal and said inner part is made of a second metal.

17. The torsion generator according to claim 16, wherein said first metal is steel and said second metal is titanium.

18. The torsion generator according to claim 14, characterized in that the solid material is selected from the group consisting of ceramics, metal ceramics and wear-proof plastic.

19. The torsion generator according to claim 13, wherein said camera has a symmetrical cross section.

20. The torsion generator according to claim 19, wherein said camera is cylindrical.

21. The torsion generator according to claim 20, wherein said camera has a longitudinal axis and said casing has a longitudinal axis, and wherein said longitudinal axis of said camera is eccentrically situated with respect to said longitudinal axis of said casing.

22. The torsion generator according to claim 13, wherein said at least one canal is two canals.

23. The torsion generator according to claim 22, wherein said two canals are in communication.

* * * * *